US005459901A

United States Patent [19]

Blase et al.

[11] Patent Number: 5,459,901

[45] Date of Patent: Oct. 24, 1995

[54] HOSE AND WAND ASSEMBLY FOR WATER EXTRACTION MACHINE

[75] Inventors: Michael Blase; Giovanni Pino, both of Grand Rapids; Kevin M. Kennedy, Lowell; Brenda K. Langeland, Grand Rapids, all of Mich.

[73] Assignee: Bissell Inc., Grand Rapids, Mich.

[21] Appl. No.: 181,694

[22] Filed: Jan. 14, 1994

[51] Int. Cl.[6] ..... A47L 7/00

[52] U.S. Cl. ..... 15/321; 15/322; 15/377; 174/47

[58] Field of Search ..... 15/321, 322, 353, 15/377; 174/47

[56] References Cited

U.S. PATENT DOCUMENTS

| | | | |
|---|---|---|---|
| 1,982,345 | 11/1934 | Kirby . | |
| 3,992,565 | 11/1976 | Gatfield . | |
| 4,083,077 | 4/1978 | Knight et al. . | |
| 4,123,818 | 11/1978 | Hurwitz . | |
| 4,204,297 | 5/1980 | Yasunaga et al. . | |
| 4,314,385 | 2/1982 | Wimsatt et al. | 15/321 |
| 4,333,203 | 6/1982 | Yonkers . | |
| 4,360,946 | 11/1982 | Marshall, Jr. et al. . | |
| 4,485,518 | 12/1984 | Kasper . | |
| 4,498,214 | 2/1985 | Oxel . | |
| 4,517,404 | 5/1985 | Hughes et al. | 174/47 |
| 4,534,083 | 8/1985 | Hampson . | |
| 4,787,117 | 11/1988 | Westergren . | |
| 4,800,613 | 1/1989 | Blase et al. . | |
| 4,821,364 | 4/1989 | McAllister et al. . | |
| 4,829,624 | 5/1989 | Lackner et al. . | |
| 4,845,802 | 7/1989 | Miller et al. . | |
| 4,887,330 | 12/1989 | Woodhall et al. . | |
| 4,893,375 | 1/1990 | Girman et al. | 15/321 |
| 4,910,828 | 3/1990 | Blase et al. . | |
| 4,955,104 | 9/1990 | Miller . | |
| 4,998,317 | 3/1991 | Passien . | |
| 5,103,526 | 4/1992 | Berfield . | |
| 5,109,568 | 5/1992 | Rohn et al. . | |
| 5,189,755 | 3/1993 | Yonkers et al. . | |
| 5,224,237 | 7/1993 | Ambrosiano . | |
| 5,237,720 | 8/1993 | Blase et al. . | |
| 5,400,462 | 3/1995 | Amoretti | 15/321 |

*Primary Examiner*—Christopher K. Moore
*Attorney, Agent, or Firm*—Varnum, Riddering, Schmidt & Howlett

[57] ABSTRACT

The water extraction machine according to the invention provides a quick connect system for mounting one end of a solution tube and vacuum hose to the water extraction machine housing and a simple and efficient means for conveying solution from the housing to a cleaning tool. One end of the vacuum hose and solution tube are received in a cuff member which is adapted to be received in the machine housing by a simple press fit interconnection. The cuff member provides a single connection for both the vacuum hose and the solution hose to the machine housing. The other end of the vacuum hose and solution tube are received in a clam shell grip tube handle which is in turn mounted to an extruded dual chamber wand. A first longitudinal chamber in the wand conveys vacuum through the wand and the second longitudinal channel conveys cleaning solution from the grip tube to the cleaning tool. The structure for the water extraction machine according to the invention results in a more efficient system for conveying cleaning solution and vacuum to and from the machine housing and cleaning tool. In addition, the system is adapted for quick assembly and disassembly by the user.

22 Claims, 5 Drawing Sheets

HOSE AND WAND ASSEMBLY FOR WATER EXTRACTION MACHINE

BACKGROUND OF THE INVENTION

1. Field of the Invention

This invention relates to water extraction machines and, more particularly, to the hose and wand assembly used to convey cleaning solution and the source of suction between the water extraction machine and the cleaning tool.

2. Description of Related Art

Deep cleaning or water extraction machines are well known. These machines apply a cleaning solution mixture to a surface to be cleaned and then apply a source of vacuum to the surface to be cleaned to remove the cleaning solution and dirt and dust entrapped in the cleaning solution. Examples of known water extraction machines are disclosed in U.S. Pat. No. 5,237,720 issued Aug. 24, 1993 to Blase et al.; U.S. Pat. No. 5,189,755 issued Mar. 2, 1993 to Yonkers et al.; and U.S. Pat. No. 4,910,828 issued Mar. 27, 1990 to Blase et al.

The known water extraction cleaning machines typically have a cleaning solution chamber, a solution tube extending from the chamber to the cleaning tool and means for pressurizing the solution to convey it from the cleaning solution chamber through the solution tube to the hose. One known means of securing the solution tube to the machine housing and to the cleaning tool comprises a threaded stem extending outwardly from both the tool and the machine housing and a nut mounted on each of the ends of the solution tube to securely fasten the solution tube to the machine housing and the cleaning tool. One problem with this structure is the time and effort required to assemble and disassemble the tool, solution tube and machine housing.

Conventional water extraction machines also typically include a vacuum hose extending from the machine housing to the cleaning tool. It is known to telescopically mount one end of the vacuum hose on a stem extending outwardly from the machine housing and mount a second end of the vacuum hose to a first end of a grip tube. It is also known to mount a second end of the grip tube to a rigid wand which extends downwardly from the grip tube to the surface cleaning tool.

One problem which exists in the prior art water extraction cleaning machines is an efficient and quick means for connecting the solution tube and vacuum hose to the water extraction machine housing and to the surface cleaning tool.

SUMMARY OF THE INVENTION

The water extraction machine according to the invention overcomes the problems of the prior art by first providing a quick and efficient means for connecting the solution tube and vacuum hose to the machine housing. The water extraction machine according to the invention also provides a simple, uncomplicated means for conveying the solution and vacuum from the machine housing to the cleaning tool.

The invention comprises an improved water extraction machine having a machine housing, a vacuum hose having a first end mounted to the machine housing, a solution tube having a first end mounted to the machine housing and a cleaning tool in fluid communication with vacuum hose and the solution tube. The improvement in the water extraction machine comprises a cuff member selectively mounted to the machine housing. The cuff member mounts the first end of the vacuum hose and the first end of the solution tube such that the vacuum hose and the solution tube are in fluid communication with the machine housing when the cuff member is mounted to the machine housing.

In one embodiment, an interlocking projection is mounted on one of the cuff member and machine housing and an interlocking aperture is mounted on the other of the cuff member and machine housing for selectively mounting the cuff member to the machine housing.

In another embodiment, a cuff insert has one end mounted to the first end of the solution tube and a male connector mounted to another end thereof. The male connector is received in the machine housing and the cuff insert has a channel formed therein to fluidly connect the solution tube to the machine housing.

In still another embodiment, the improved water extraction machine further comprises a grip tube handle having a handle solution conduit supported therein. The handle solution conduit has a first end mounted to a second end of the solution tube and a second end interconnected to a cleaning tool. The handle solution conduit is formed of a resilient material and has a cover which substantially surrounds the handle solution conduit and tends to maintain the handle solution conduit in a circular cross sectional configuration. A trigger projection bears against the handle solution conduit to selectively pinch off the fluid flow through the handle solution conduit.

In yet another embodiment, the invention further comprises at least one wand member interconnected with a vacuum hose and the solution tube. The at least one wand member has a first conduit integrally formed therein and a second conduit integrally formed therein. The first integral conduit is connected to the vacuum hose and the second integral conduit is connected to the solution tube. Preferably, two wand members are used and at least one wand interconnecting member connects one end of a first wand member to one end of a second wand member. The at least one wand interconnecting member has a first interconnecting conduit and a second interconnecting conduit. The first interconnecting conduit provides a fluid passageway between the first conduits of the first and second wand members. The second interconnecting conduit provides a fluid passageway between the second conduits of the first and second wand members.

BRIEF DESCRIPTION OF THE DRAWINGS

The invention will now be described with reference to the drawings wherein.

DESCRIPTION OF THE PREFERRED EMBODIMENT

Figure 1:
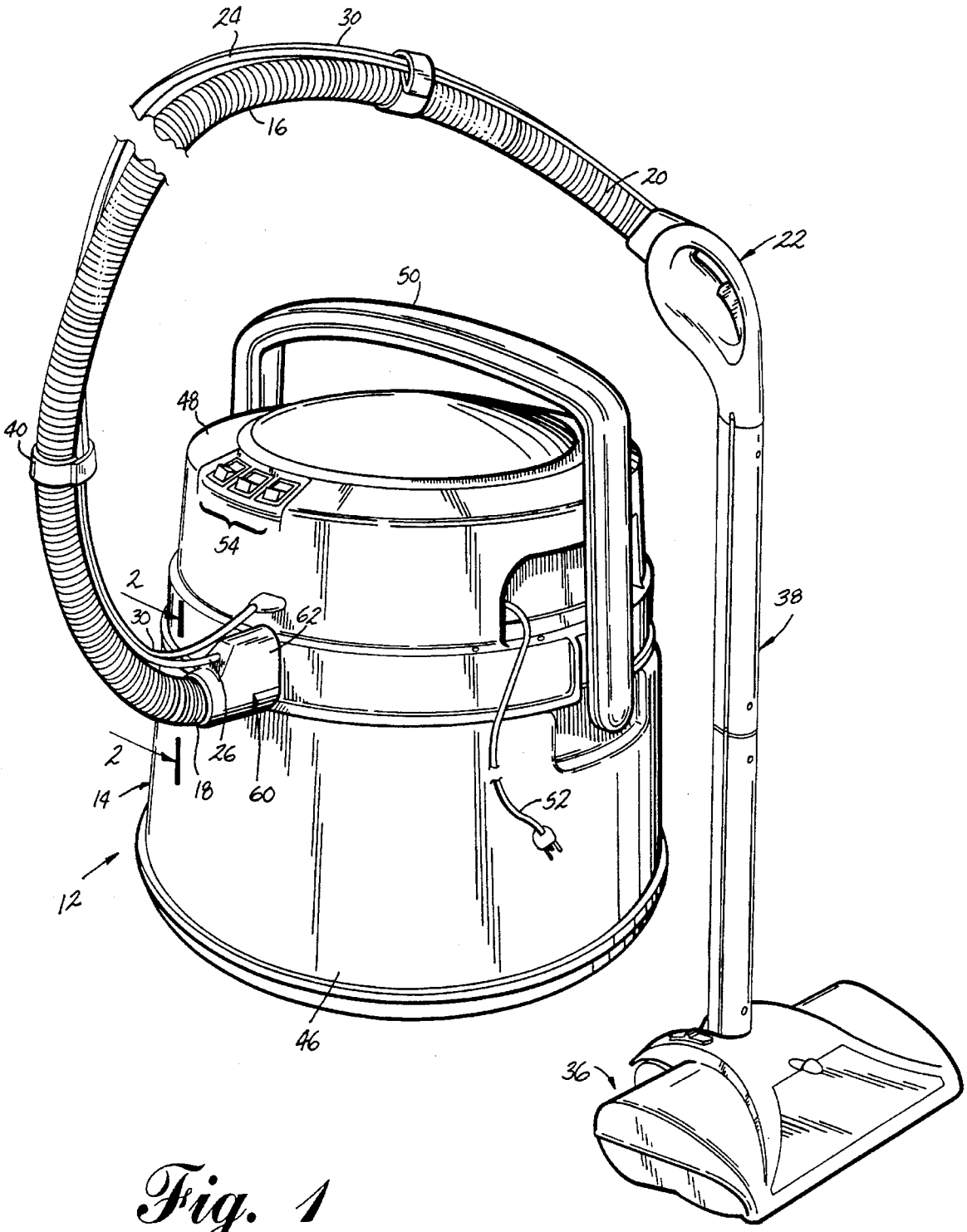
FIG. 1 is a perspective view of a water extraction machine incorporating the hose and wand assembly according to the invention.

Referring now to the drawings, the wand and hose connection system according to the invention is ideally suited for use in a water extraction machine as seen in FIG. 1. The water extraction machine 12 comprises a machine housing 14, a vacuum hose 16 having a first end 18 mounted to the machine housing 14 and a second end 20 mounted to a grip tube 22 and a solution tube 24 having a first end 26 received in the machine housing 14 and a second end 28 received in a grip tube 22. A cleaning tool is spaced from the machine housing and adapted to wash the surface to be cleaned. Cleaning tools which are suitable for use according to the invention include a hand held upholstery cleaning tool, a ground engaging cleaning tool having a brush fixedly mounted thereto or a ground engaging powered foot having an agitation brush rotatably mounted therein. The water extraction machine according to the invention as seen in FIG. 1 depicts a ground supported power foot 36. A power foot electrical cord 30 extends between the machine housing 14 and the power foot 36 and has a first end received in the machine housing 14 and a second end received in the power foot 36. A plurality of hose retention clips 40 surround the vacuum hose 16, solution tube 24 and power foot electrical cord 30 along the length of the vacuum hose 16 and hold these several members together as an assembly. A wand assembly 38 extends from the grip tube 22 to the power foot 36.

The machine housing 14 comprises a solution reservoir housing 46 and a vacuum motor housing 48 mounted on top thereof. The solution reservoir housing 46 has a clean solution reservoir (not shown) and a dirty solution reservoir (not shown). A conventional solution pump (not shown) is mounted in the vacuum motor housing 48 and is adapted to pressurize the cleaning solution in the cleaning solution reservoir. The pressurized solution flows from the machine housing 14 to the cleaning tool for application to the surface to be cleaned. A conventional vacuum motor is mounted in the vacuum motor housing 48 and is adapted to create a source of suction to remove the previously applied cleaning solution and convey it to the dirty solution reservoir. A handle 50 is pivotally mounted to the solution reservoir housing 46 and is adapted to securely lock the vacuum motor housing 48 to the solution reservoir housing 46 when the machine is assembled for operation. A main electrical cord 52 extends outwardly from the vacuum motor housing 48, is adapted to be received in a conventional electrical outlet and supplies all necessary electrical current to the vacuum motor housing 48. A plurality of electrical switches 54 are mounted on the exterior of the vacuum housing 48. One of the switches is used to turn the vacuum motor on and off, one to turn the pump motor on and off, and one to turn the agitation motor of the power foot on and off. A more detailed description of the structure of the machine housing is disclosed in U.S. Pat. application Ser. No. 757,249 filed Sep. 10, 1991, which is incorporated herein by reference.

Figure 2:
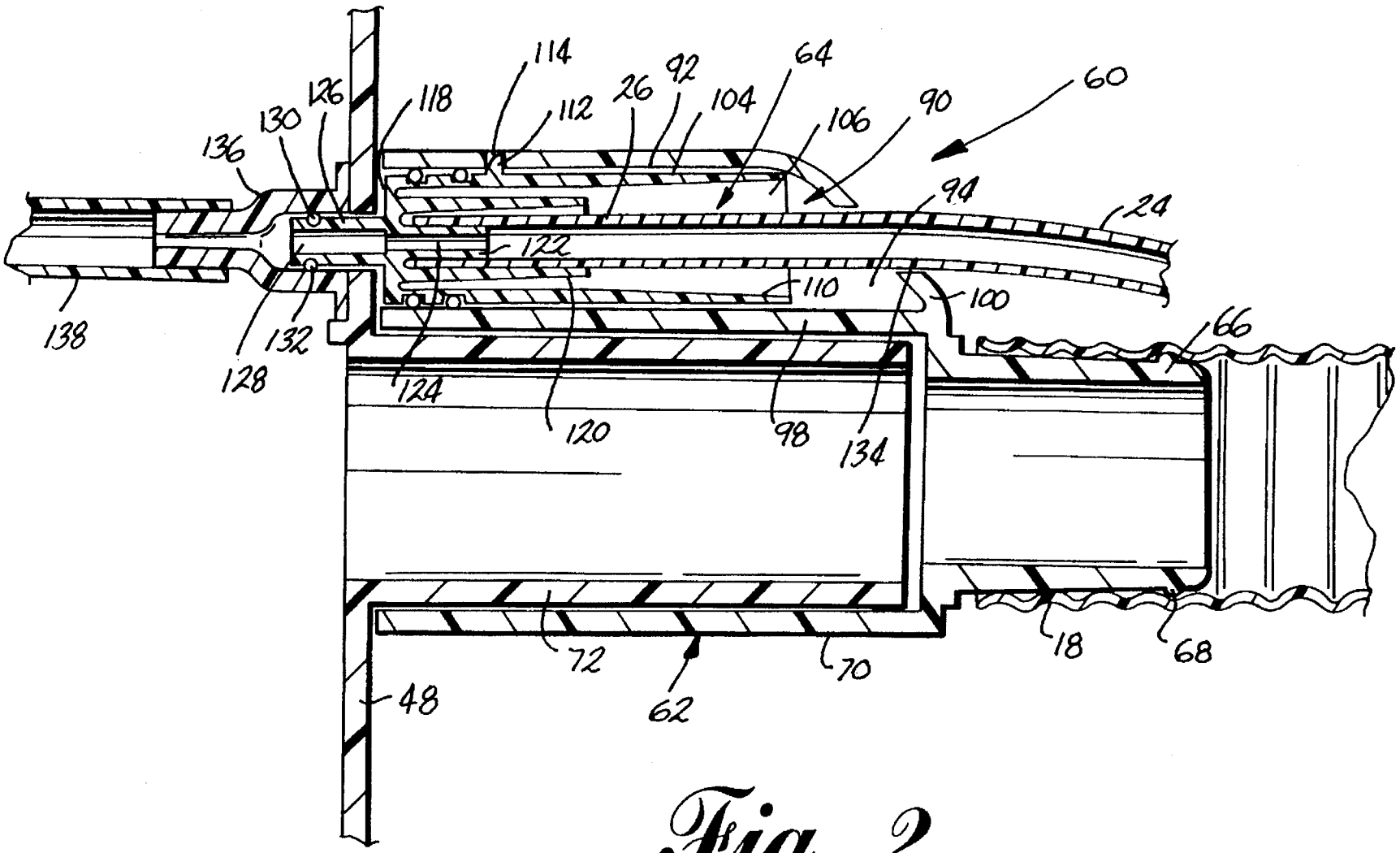
FIG. 2 is a cross sectional view taken along lines 2—2 of FIG. 1 showing the cuff assembly mounting to the housing of the water extraction machine according to the invention.
Figure 3:
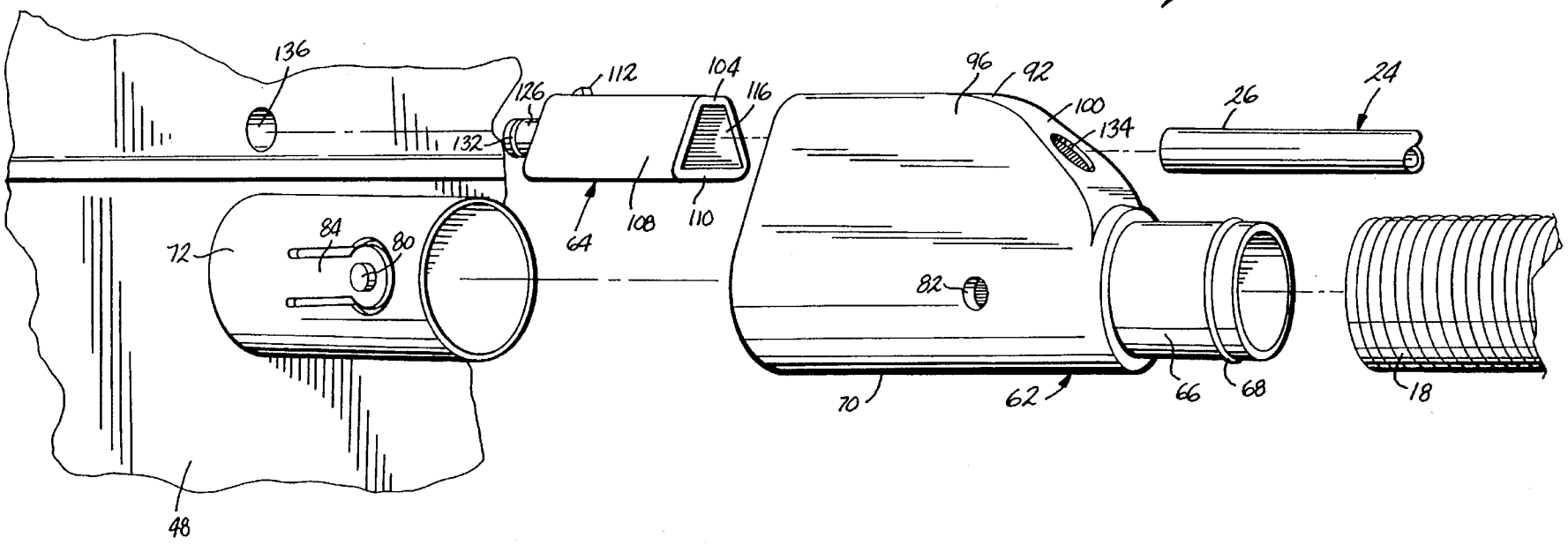
FIG. 3 is an exploded view of the cuff assembly shown in FIGS. 1 and 2.

As seen in FIGS. 1–3, the vacuum hose 16 and solution tube 24 are mounted to the machine housing 14 by a cuff assembly 60. The cuff assembly 60 is designed such that the vacuum hose 16 and solution tube 24 can be quickly and easily mounted to the machine housing with minimal effort by the user.

The cuff assembly 60 comprises a cuff member 62 and a cuff insert 64 selectively received inside the cuff member 62. The cuff member 62 comprises an outwardly extending tubular vacuum hose mounting 66 which is adapted to telescopically receive the second end 20 of the vacuum hose 16. The vacuum hose mounting 66 is circular in cross section and has an outer diameter which closely approximates the internal diameter of the vacuum hose 16 to create a snug friction fit for the hose 16 on the vacuum hose mounting 66. An annular mounting rib 68 is formed on the outside surface of the vacuum hose mounting 66 and engages the inside surface of the vacuum hose 16 to enhance the friction fit of the hose on the hose mounting 66.

A tubular stem 72 extends outwardly from the vacuum motor housing 48 of the water extraction machine 12. The stem is adapted to be received in a stem mounting 70 of the cuff member 62. Preferably, the stem 72 and stem mounting 70 are hollow and substantially circular in cross section wherein the inside diameter of the stem mounting 70 closely approximates the outside diameter of the circular stem 72.

The cuff member 62 is selectively retained on the stem 72 by the interengagement of an outwardly extending interlocking projection 80 formed on one of the stem 72 and stem mounting 70 and a complementary interlocking aperture 82 formed on the other of the stem 72 and stem mounting 70. Preferably, the interlocking aperture 82 is formed on the stem mounting 70 and the interlocking projection 80 is mounted on one end of a cantilever arm 84, the second end of the arm being mounted to the stem 72. The cantilever arm 84 is preferably made of a resilient material such that the interlocking projection 80 and arm 84 can be deflected bringing the projection into and out of engagement with the interlocking aperture 82. The interlocking aperture 82 is formed in the stem mounting 70 at a position such that the aperture 82 receives the interlocking projection 80 when the cuff member 62 is fully received on the stem 72.

The cuff member 62 is mounted to the stem 72 by telescopically mounting the cuff member 62 on the outside of the stem 72 such that the interlocking projection 80 is received in the interlocking aperture 82. The cuff member 62 can be easily removed from the stem 72 by depressing the interlocking projection 80, thereby deflecting the cantilever arm 84 such that the projection 80 is no longer received in the interlocking aperture 82.

A unique feature of the cuff member 62 is that it is adapted to mount both the vacuum hose and the solution tube 24 to the machine housing 14 as a single interconnection. To accomplish this interconnection, the cuff member 62 further comprises an insert chamber 90 which is defined by a top wall 92, a pair of opposed side walls 94, 96, a bottom wall 98 and an end wall 100 mounted on one end of the insert chamber 90. The second end of the insert chamber 90 is open and adapted to receive the first end 26 of the solution tube 24 and the cuff insert 64. The cuff insert 64 receives the first end 26 of the solution tube 24 and interconnects the solution tube 24 to the machine housing 14. The cuff insert 64 is substantially complementary in shape to the insert chamber 90 and comprises a top wall 104, a pair of opposed side walls 106, 108 and a bottom wall 110. An interlocking projection 112 extends upwardly from the top wall 104 of the cuff insert 64 and is adapted to be received in an interlocking aperture 114 formed in the top wall 92 of the insert chamber 90 when the solution hose mounting member 102 is fully received in the insert chamber 90.

One end of the cuff insert 64 has an opening formed therein exposing the substantially hollow interior of the cuff insert 64. The second end of the cuff insert 64 is closed by an end wall 118. A first cylindrical flange 120 extends into the hollow interior of the cuff insert 64 from the end wall 118. A second cylindrical flange 122 extends inwardly from the end wall 118 and is telescopically received inside the first cylindrical flange. An axial aperture 124 extends through the second cylindrical flange 122 and the end wall 118.

The inside diameter of the first cylindrical flange 120 is slightly greater than the outside diameter of the solution hose 24 and the outside diameter of the second cylindrical flange 122 is slightly less than the inside diameter of the solution tube 24. The solution hose 24 is securely mounted to the cuff insert 64 by applying a conventional adhesive or cement to the first end 26 of the solution tube 24 and then inserting the first end 26 into the hollow interior of the cuff insert 64 such that the solution tube 24 is telescopically received inside the first cylindrical flange 120 and telescopically received onto the second annular flange 122.

A male connector 126 extends outwardly from the end wall 118 of the cuff insert 64. The male connector has an axial channel 128 formed therein which is in fluid communication with the axial aperture 124, the hollow interior of the second cylindrical flange and the hollow interior of the solution hose 24. The male connector 126 also has formed on the outside surface thereof an annular groove 130 which is adapted to receive a conventional O-ring 132.

As seen in FIG. 2, the male connector 126 extends beyond the end of the cuff member 62 when the cuff insert 64 is received in the insert chamber 90. The male connector 126 is adapted to be received in a female connector 136 mounted in the machine housing 14. A solution conduit 138 extends from the female connector 136 to the cleaning solution reservoir (not shown). With this configuration, a cleaning solution flowpath extends from the cleaning solution reservoir through the solution conduit 138, the female connector 136, the male connector 126, the first cylindrical flange 120 and the solution tube 24 to supply cleaning solution from the machine housing 14 to the cleaning tool.

The cuff assembly 60 is assembled by first inserting the first end 26 of the solution tube 24 into the cuff insert 64 and securing the tube therein by cement or other suitable adhesive. Next, the second end 28 of the solution tube 24 is inserted into the open end of the insert chamber 90 and through a solution tube aperture 134 formed in the end wall 100 of the insert chamber 90. Substantially the entire length of the solution tube 24 is pulled through the insert chamber 90 until the interlocking projection 112 of the cuff insert 64 engages the interlocking aperture 114 of the cuff member 62 at which point the cuff insert 64 is fully received in the insert chamber 90. Next, the first end 18 of the vacuum hose 16 is telescopically received on the vacuum hose mounting 66 of the cuff member 62. The annular mounting rib 68 retains the vacuum hose 18 on the vacuum hose mounting 66.

Figure 4:
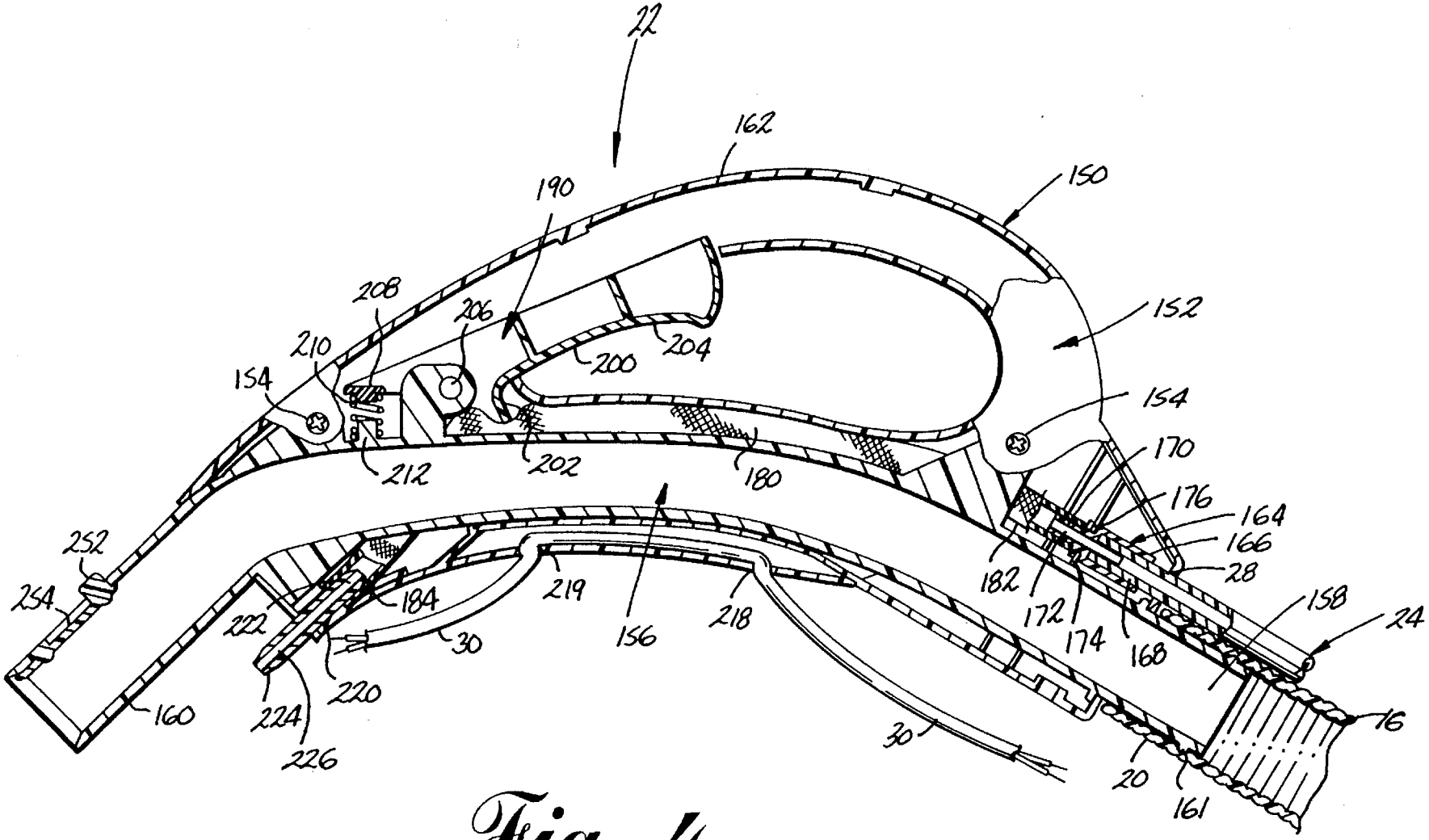
FIG. 4 is a cross sectional view of the grip tube handle according to the invention.

As seen in FIGS. 1 and 4, the vacuum hose 16 and solution tube 24 extend from the machine housing to the grip tube 22. The grip tube comprises a pair of opposed handle halves 150, 152 which are selectively mounted to one another by a plurality of conventional fasteners 154. The two handle halves 150, 152, define therebetween a substantially hollow interior which incorporates therein means to convey the vacuum and the cleaning solution through the grip tube 22.

The second end 20 of the vacuum hose 16 is telescopically received on a first end 158 of a rigid vacuum conduit 156 which is mounted inside the grip tube 22. The vacuum conduit 156 is tubular and substantially cylindrical in cross section and has an annular mounting rib 161 formed on the first end 158 to retain thereon the second end 20 of the vacuum hose 16. The vacuum conduit 156 extends through the body of the grip tube 22 such that a second end 160 of the vacuum conduit extends outwardly from the opposite end of the grip tube 22. The second end 160 of the vacuum conduit 156 is adapted to be mounted to the wand assembly 38 (FIG. 1) which will be described in greater detail below.

The second end 28 of the solution tube 24 is received in a solution connecting member 164 which interconnects the second end 28 of the solution tube 24 to a first end 182 of a reinforced silicone tube 180. The solution connecting member 164 comprises a first annular flange 166 which is cylindrical in cross section, hollow and adapted to telescopically receive in the interior thereof the second end 28 of the solution tube 24. A second annular flange 168 is concentrically mounted inside the first annular flange 166 and is adapted to telescopically receive thereon the second end 28 of the solution tube 24. Mounted opposite the first and second annular flanges 166, 168 is a male connector 170. The male connector 170 is adapted to telescopically receive the first end 182 of a reinforced silicone tube 180. An axial channel 172 extends through the male connector 170 and the second annular flange 168 of the solution connecting member thereby creating a fluid flowpath for solution from the solution tube 24 to the reinforced silicone tube 180. The solution connecting member 164 is securely mounted in the grip tube handle 22 through the interengagement of an annular channel 174 formed on the solution connecting member 164 which receives a support rib 176 integrally formed in the grip tube 22.

The reinforced silicone tube 180 extends through the grip tube 22 and is adapted to cooperate with a trigger mechanism 190 within the handle to control the flow of solution from the machine housing 14 to the cleaning tool. The trigger mechanism 190 is mounted in the grip tube 22 intermediate the first and second ends 182, 184 of the reinforced silicone tube 180. The trigger mechanism comprises a pivotally mounted trigger 200 having an outwardly extending projection 202 which selectively pinches closed the reinforced silicone tube 180. The trigger 200 comprises a finger grip portion 204 which extends outwardly from the grip tube handle 162 so that it can be grasped by the user and a pivot pin 206 which pivotally mounts the trigger 200 to an upwardly extending boss 214 of the vacuum conduit 156. An outwardly extending lever arm 208 formed on the trigger and mounted on the opposite side of the pivot pin 206 from the finger grip portion 204 engages one end of a compression spring 210. The other end of the spring 210 is mounted on a spring mounting projection 212 integrally formed on the vacuum conduit 156. The spring 210 is under compression and biases the lever arm 208 upwardly as seen in FIG. 4. In the biased position, the lever arm 208 is biased upwardly so that the projection 202 bears downwardly against the reinforced silicone tube 180 thereby pinching the reinforced silicone tube 180 against the body of the vacuum conduit 156 such that no solution passes therethrough. When the user of the water extraction machine 12 desires to apply solution to the surface to be cleaned, the user squeezes the finger grip portion 204 of the trigger 200 thereby pivoting the projection 202 upwardly away from the reinforced silicone tube 180 such that pressurized cleaning solution can freely flow through the reinforced silicone tube 180. The spring 210 resists the pivoting movement of the trigger 200.

One of the problems which has plagued manufacturers of water extraction machines 12 is the selection of a suitable solution conduit which can be pinched closed for an extended period of time by a pivoting trigger mechanism and then, upon release of the pinching pressure, open to allow the free flow of solution therethrough. The water extraction machine 12 according to the invention includes a reinforced silicone tube 180 in the trigger mechanism 190 to provide a solution tube having sufficient strength to withstand the pressure from the solution pump (not shown) while also having sufficient elasticity, resiliency and memory properties to allow the free flow of solution therethrough upon removal of the pinching pressure from the projection 202. Preferably, the reinforced silicone tube 180 comprises a conventional extruded silicone tube having a plastic or fabric braided mesh sleeve 216 surrounding the body of the tube 180. The braiding takes place as the tube is extruded so that it is tightly bonded to the outer surface of the silicone tubing. The sleeve 216 is preferably a plurality of thermoplastic filaments which are braided onto the silicone tubing. The sleeve surrounds the tube such that the inside diameter of the braided sleeve closely approximates the outside diameter of the reinforced silicone tube 180 under normal operating conditions. The braiding serves several purposes in creating an improved wand handle. First, the braiding provides additional abrasion resistance to withstand the cyclical engagement and disengagement of the projection with the tube. Secondly, the braided sleeve strengthens the tube to prevent undue expansion or bursting of the tube. When pressurized fluid is flowing through the tube and the tube is suddenly closed, the relative pressure of the fluid within the tube will continue to rise until the pump discontinues pressurizing the solution. The sleeve restricts expansion of the tube and prevents bursting thereof. While the reinforced silicon tube 180 is preferably formed of silicone, any elastomeric material having sufficient resiliency and memory to withstand the pinching and opening of the tube by the trigger mechanism can be utilized. In addition, other suitable materials for forming the braided sleeve include fabric and extruded thermoplastic filaments.

As seen in FIG. 4, the reinforced silicone tube 180 extends from the solution connection member 164 through the body of the grip tube 22 to a second solution connecting member 220. The second solution connecting member 220 comprises a first male connector 222 and a second male connector 224. The first male connector 222 telescopically receives the second end 184 of the reinforced silicone tube and the second male connector 224 is adapted to be received in the wand assembly 38 which will be described in greater detail below. An axial channel 226 extends through the second solution connecting member 220 such that pressurized cleaning solution can freely flow from the second end 184 of the reinforced silicone tube 180 to the wand assembly 38.

The power foot electrical cord 30 is also mounted to the grip tube 22. As seen in FIG. 4, the power foot electrical cord 30 enters the hollow interior of the grip tube 22 through a first aperture 218, extends a short distance inside the grip tube 22 and exits the grip tube 22 through a second electrical cord aperture 219. As described previously, the portion of the electrical cord 30 between the grip tube 22 and the machine housing 14 is bound to the vacuum hose 16 by a plurality of hose retention clips 40. As will be described detail below, the portion of the power foot electrical cord 30 between the grip tube 22 and the power foot 36 is received in the wand assembly 38. Therefore, the entire length of the electrical cord between the machine housing 12 and the power foot 36 is contained to prevent damaging the cord during use and to create an organized assembly.

Figures 5, 6:
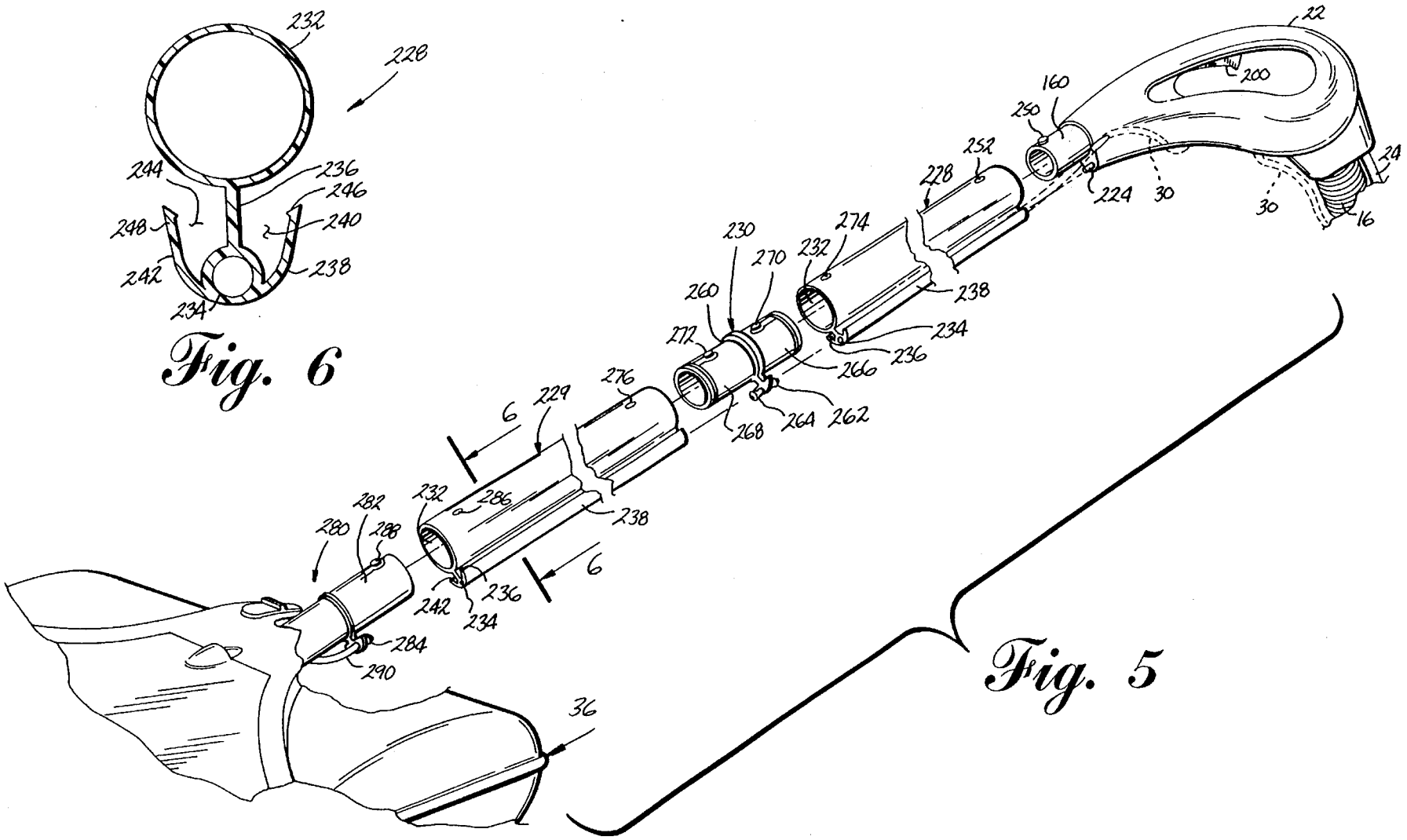
FIG. 5 is an exploded view of the grip tube handle, wand and pivot tee of the ground engaging foot according to the invention.
FIG. 6 is a cross sectional view of the wand taken along lines 6—6 of FIG. 5.

As seen in FIGS. 5 and 6, the wand assembly 38 comprises an upper extruded wand member 228, a lower extruded wand member 229 and a wand interconnecting member 230 selectively mounting the two wand members to one another. While the wand assembly of the preferred embodiment comprises two extruded wand members 228, 229 and a single wand interconnecting member 230, it is within the scope of the invention to utilize a single extruded wand member, thereby eliminating the need for a wand interconnecting member or to have more than two extruded wand members and wand interconnecting members.

The extruded wand members 228, 229 are identical in structure and preferably comprise an extruded profile formed of a rigid thermoplastic material comprising a first axial conduit 232, a second axial conduit 234 and a rib 236 interconnecting the first and second axial conduits 232, 234. A first flange 238 extends tangentially away from the second axial conduit 234 and cooperates with the body of the second axial conduit 234 and the rib 236 to define therein a first axial groove 240. Similarly, a second flange 242 extends tangentially away from the body of the second axial conduit and defines, in cooperation with the rib 236 and the body of the second axial conduit, a second axial groove 244. Preferably, first and second retaining tabs 246, 248 are formed at the terminal ends of the first and second flanges 238, 242, respectively.

The upper extruded wand member 228 is adapted to receive the second male connector 224 of the second solution connecting member 220 in the second axial conduit 234 and receive the second end 160 of the vacuum conduit 156 in the first axial conduit 232. The upper extruded wand member 228 has an interlocking aperture 250 which is adapted to receive a complementary interlocking projection 252 which is mounted at the end of a cantilevered arm 254 (FIG. 4), one end of which is secured to the vacuum conduit 156. Preferably, the cantilever arm 254 (FIG. 4) is made of a resilient material such that the interlocking projection 252 is biased into engagement with the interlocking aperture 250 to securely lock the upper extruded wand member 228 to the grip tube 22.

The wand interconnecting member 230 comprises a central portion 260 having a pair of opposed male solution connectors 262, 264 and a pair of opposed male vacuum connectors 266, 268. The first male solution connector 262 and first male vacuum connector 266 are adapted to be received in the second axial conduit 234 and first axial conduit 232, respectively, at the lower end of the upper extruded wand member 228. The second male solution connector and the second male vacuum connector are adapted to be received in the second axial conduit 234 and first axial conduit 232, respectively, at the upper end of the lower extruded wand member 229. The first and second male vacuum connectors 266, 268 each support a cantilever arm and interlocking projection assembly 270, 272 which are received in interlocking apertures 274, 276 formed in the wand members 228, 229 similar to that described above. The wand interconnecting member 230 serves the dual function of interconnecting the upper and lower wand members 228, 229 and also having formed therein conduits for conveying the cleaning solution and the source of vacuum therethrough.

The bottom end of the lower extruded wand member 229 is received on a pivot tee 280 of the power foot 36. The pivot tee 280 has a first conduit 282 adapted to be received inside the first axial conduit 232 of the lower wand member 229. The first conduit 282 of the pivot tee conveys the dirt and dust entrapped in the vacuum flow from the power foot 36 to the wand assembly 38. An upwardly extending male connector 284 is adapted to be received in the second axial conduit 234 at the bottom of the lower wand member 229. The male connector 284 receives the pressurized flow of cleaning solution from the machine housing 14, through the solution tube 24, the grip tube 22 and the wand assembly 38.

The bottom end of the lower wand member 229 is selectively mounted to the pivot tee 280 through the cooperation of an interlocking aperture 286 formed on the bottom end of the lower wand member and a resilient interlocking projection 288 formed on the first conduit 282 of the pivot tee 280.

One of the first and second axial grooves 240, 244 of the wand assembly 38 are ideally suited to receive the power foot electrical cord 30 and provide a safe mounting for the cord 30 between the grip tube 22 and the power foot 36. The other of the first and second axial grooves 240, 244 can receive and retain therein an additional solution tube, conduit, power cord or the like as may be required by the cleaning machine. The retaining tabs 246, 248 mounted at the ends of the first and second flanges 238, 242, respectively, prevent inadvertent removal of the power foot electrical cord 30 or other conduit or cord from the grooves.

While the invention has been described with respect to a cleaning tool comprising a power foot which requires a source of electricity, the scope of the invention is broad enough to include cleaning tools which do not incorporate an electrical motor or other powered means in the cleaning tool. The extruded shape of the wand, the unique construction of the grip tube 22 and the quick connect of the cuff member 62 according to the invention provide the same benefits with or without the use of electricity in the cleaning tool.

In operation, the water extraction machine 12 can be quickly and easily assembled without the use of tools. First, the cuff assembly 60 is mounted to the machine housing 14 such that the stem 72 is received inside the cuff member 62 and the male connector 126 of the cuff insert 64 is received in the female connector 136 of the machine housing 14. The cuff assembly 60 is simply slipped onto the stem 72 and oriented such that the male connector 126 is received in the female connector 136 and the interlocking projection 80 is received in the interlocking aperture 82. The second end 20 of the vacuum hose 16 and the second end 28 of the solution tube 24 are mounted to the grip tube 22 at the factory and therefore no further assembly or disassembly of these components is required by the user. Next, the user telescopically mounts the upper end of the first wand member 228 onto the second end 160 of the vacuum conduit 156. The upper wand member 228 is interlocked to the grip tube 22 through the cooperation of the interlocking projection and aperture. Next, the lower wand member 229 is mounted to the first wand member 228 by the snap-fit connection of the wand interconnecting member 230 with the two extruded wand members. Finally, the lower end of the second wand member is snap-fit onto the pivot tee 280. In the assembled condition, the user can now begin the water extraction cleaning process. The unique design of the wand provides additional strength and significant cost savings over a conventional aluminum vacuum tube.

The water extraction machine according to the invention can be quickly disassembled and stored in a convenient, compact configuration. First, the cuff member 62 is removed from the machine housing 14 by depressing the interlocking projection 80 thereby disengaging it from the interlocking aperture 82. Next, the wand assembly 38 can be removed from the grip tube 22 by disengaging the several interlocking projections and apertures. The power foot 36 can be disconnected from the wand assembly 38 by disengaging the interlocking projection and recess. Finally, the wand assembly 38 can be disassembled by disengaging the interlocking projection and recess between one of the wand members 228, 229 and the wand interconnecting member 230.

Ease of use and ease of assembly and disassembly is of critical importance for consumer acceptance of cleaning machines such as a water extraction machine. The water extraction machine 12 according to the invention provides a significant improvement over the prior art water extraction machines by providing simple yet effective means for assembling and disassembling the machine.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure without departing from the spirit of the invention.

The embodiments of the invention in which an exclusive property or privilege is claimed are defined as follows:

1. An improved water extraction machine comprising a machine housing, a vacuum hose having a first end mounted to the machine housing, a solution tube having a first end mounted to the machine housing and a cleaning tool in fluid communication with the vacuum hose and the solution tube, wherein the improvement comprises;

a cuff member mounted to the machine housing, the cuff member mounting the first end of the vacuum hose and the first end of the solution tube such that the vacuum hose and the solution tube are in fluid communication with the machine housing when the cuff member is mounted to the machine housing.

2. An improved water extraction machine according to claim 1 and further comprising an interlocking projection mounted on one of the cuff member and machine housing and an interlocking aperture mounted on the other of the cuff member and machine housing for selectively mounting the cuff member to the machine housing.

3. An improved water extraction machine according to claim 2 wherein the machine housing further comprises an outwardly extending stem and the cuff member has an opening which is telescopically received on the stem.

4. An improved water extraction machine according to claim 1 and further comprising a cuff insert having one end mounted to the first end of the solution tube and a male connector mounted on another end thereof, the male connector being received in the machine housing and the cuff insert having a channel formed therein to fluidly connect the solution tube to the machine housing.

5. An improved water extraction machine according to claim 4 and further comprising an insert chamber formed in the cuff member, the insert chamber receiving the cuff insert and the solution tube.

6. An improved water extraction machine according to claim 5 and further comprising an interlocking projection formed on one of the cuff insert and the cuff member and an interlocking aperture formed on the other of the cuff insert and cuff member, the projection and aperture cooperating to selectively interlock the cuff insert and cuff member.

7. An improved water extraction machine according to claim 1 and further comprising a grip tube handle having a handle solution conduit supported therein, the handle solution conduit having a first end mounted to a second end of the solution tube and a second end interconnected to a cleaning tool, the handle solution conduit being formed of a resilient material and having a cover which substantially surrounds the handle solution conduit and tends to maintain the handle solution conduit in a circular cross sectional configuration and a trigger projection which bears against the handle solution conduit to selectively pinch off the fluid flow through the handle solution conduit.

8. An improved water extraction machine according to claim 7 wherein the cover comprises a plurality of braided filaments.

9. An improved water extraction machine according to claim 7 wherein the filaments are selected from the group comprising fabric and thermoplastic materials.

10. An improved water extraction machine according to claim 1 and further comprising at least one wand member interconnected with the vacuum hose and the solution tube, the at least one wand member having a first conduit integrally formed therein and a second conduit integrally formed therein, the first integral conduit being connected to the vacuum hose and the second integral conduit being connected to the solution tube.

11. An improved water extraction machine according to claim 10 and further comprising at least one wand interconnecting member to connect one end of a first wand member to one end of a second wand member, the at least one wand interconnecting member having a first interconnecting conduit and a second interconnecting conduit, the first interconnecting conduit providing a fluid passageway between the first conduits of the first and second wand members and the second interconnecting conduit providing a fluid passageway between the second conduits of the first and second wand members.

12. An improved water extraction machine according to claim 11 and further comprising at least one O-ring mounted on at least one of the first interconnecting conduit and second interconnecting conduit of the at least one wand interconnecting member.

13. An improved water extraction machine comprising a machine housing, a vacuum hose having a first end mounted to the machine housing, a solution tube having a first end mounted to the machine housing and a cleaning tool in fluid communication with the vacuum hose and the solution tube, wherein the improvement comprises;

at least one wand member interconnecting the vacuum hose and solution tube with the cleaning tool, the at least one wand member having a first integrally molded fluid channel and a second integrally molded fluid channel, the first integrally molded fluid channel interconnecting the vacuum hose and the cleaning tool and the second integrally molded fluid channel interconnecting the solution tube and the cleaning tool.

14. An improved water extraction machine according to claim 13 and further comprising a grip tube handle mounted intermediate the at least one wand member and the solution tube and vacuum hose, the grip tube handle having a first conduit having first and second ends and a second conduit having first and second ends, the first end of the first conduit being mounted to one end of the vacuum hose and the second end of the first conduit being mounted to the first integrally molded fluid channel, the first end of the second conduit being mounted to the solution tube and the second end of the second conduit being mounted to the second integrally molded fluid channel.

15. An improved water extraction machine according to claim 14 wherein the second conduit of the grip tube handle comprises an elastomeric tube having a braided cover substantially surrounding the elastomeric tube, the cover tends to maintain at least a portion of the second conduit in a circular cross sectional configuration; and the grip tube handle further comprises a trigger projection which bears against the elastomeric tube to selectively pinch off fluid flow therethrough.

16. An improved water extraction machine according to claim 15 wherein the braided cover comprises a plurality of braided filaments, the filaments being selected from the group comprising fabric and thermoplastic materials.

17. An improved water extraction machine according to claim 13 and further comprising a longitudinal rib mounted between the first and second integrally molded fluid channels.

18. An improved water extraction machine according to claim 17 and further comprising a first flange extending outwardly from one of the first and second integrally molded fluid channels and a longitudinal groove defined by the first flange, the longitudinal rib and said one of the first and second integrally molded fluid channels.

19. An improved water extraction machine according to claim 18 and further comprising a second flange extending outwardly from one of the first and second integrally molded fluid channels and a longitudinal groove defined by the first flange, the longitudinal rib and said one of the first and second integrally molded fluid channels.

20. An improved water extraction machine according to claim 18 and further comprising a cleaning tool electrical cord extending between the cleaning tool and the machine housing, at least a portion of the cord being received in the first longitudinal channel of the at least one wand member, wherein the cleaning tool electrical cord is a conduit for electrical current from the machine housing to the cleaning tool.

21. An improved water extraction machine according to claim 20 and further comprising a retaining tab mounted at a terminal edge of the first flange, whereby the retaining tab tends to prevent the inadvertent removal of the electrical cord from the first longitudinal groove.

22. A water extraction machine comprising:

a machine housing;

a cleaning tool spaced from the machine housing;

a grip tube located intermediate the machine housing and cleaning tool, the grip tube having a first fluid conduit having first and second ends and a second fluid conduit having first and second ends;

a vacuum hose having a first end and a second end mounted to the first end of the first fluid conduit of the grip tube;

a solution tube having a first end and a second end mounted to the first end of the second fluid conduit of the grip tube;

a wand assembly having a first end mounted to the grip tube and a second end mounted to the cleaning tool, the wand assembly comprising at least one wand member having a first integrally molded fluid channel and a second integrally molded fluid channel, the first integrally molded fluid channel being mounted to the second end of the first fluid conduit of the grip tube and the second integrally molded fluid channel being mounted to the second end of the second fluid conduit of the grip tube;

a cuff member selectively mounted to the machine housing, the cuff member mounting the first end of the vacuum hose and the first end of the solution tube such that the vacuum hose and the solution tube are in fluid communication with the machine housing when the cuff member is mounted to the machine housing;

wherein a first fluid passageway extending between the machine housing and the cleaning tool is defined by the vacuum hose, the first fluid conduit of the grip tube and the first integrally molded fluid channel of the wand member and a second fluid passageway extending between the machine housing and the cleaning tool is defined by the solution tube, the second fluid conduit of the grip tube and the second integrally molded fluid channel of the wand member.

* * * * *